United States Patent [19]

Vosper

[11] 4,372,259

[45] Feb. 8, 1983

[54] INTERNAL COMBUSTION ENGINE

[76] Inventor: George Vosper, 149 Earl St., Kingston, Canada, K7L 2H3

[21] Appl. No.: 182,029

[22] Filed: Aug. 28, 1980

[51] Int. Cl.[3] ..... F01L 1/28

[52] U.S. Cl. ..... 123/79 R

[58] Field of Search ..... 123/79 R

[56] References Cited

U.S. PATENT DOCUMENTS

| | | | |
|---|---|---|---|
| 1,951,759 | 3/1934 | Keister | 123/79 R |
| 2,215,579 | 9/1940 | Eichelberg | 123/79 R |
| 3,097,633 | 7/1963 | Klein | 123/79 R |
| 3,424,139 | 1/1969 | Brooks | 123/79 R |
| 4,075,986 | 2/1978 | Keck | 123/79 R |
| 4,273,083 | 6/1981 | Moiroux | 123/79 R |

*Primary Examiner*—Craig R. Feinberg
*Assistant Examiner*—W. R. Wolfe
*Attorney, Agent, or Firm*—Johnson & Hicks

[57] ABSTRACT

Improvements in a fuel injected, internal combustion engine having a first passage for flow of air into the combustion chamber and exit of exhaust gases from the combustion chamber and a single poppet valve opened and closed in timed relation to rotation of the engine's crank shaft to control flow of gases through such first passage wherein the improvement comprises an inlet air passage and an exhaust gas passage each communicating with the first passage and one another and a diverter valve moveable in timed relation to operation of the poppet valve selectively to direct, in one position, air into the combustion chamber through the inlet passage and, in another position, exit of exhaust gases through the outlet passage and another position therebetween where air flowing in the inlet passage flows directly to the outlet passage following the exhaust portion of the cycle to assist in driving out the exhaust gases.

2 Claims, 23 Drawing Figures

INTERNAL COMBUSTION ENGINE

This invention relates to an improvement in an internal combustion engine. In particular it applies to that class of four-stroke cycle engines using a single poppet valve in the cylinder head for both intake and exhaust. The size of poppet valve that this arrangement allows gives it a potential advantage over the conventional two-valve system. The considerably increased area of valve opening to the cylinder, when coupled with proportionately enlarged gas passages, can substantially reduce flow friction to and from the cylinders. Thermal efficiency is increased by virtue of the reduced pumping loss, and a higher volumetric efficiency also results from the improved cylinder breathing. The purpose of this invention is to exploit the potential advantage of a single valve engine to its fullest.

The only production engine of this type, to applicant's knowledge, was manufactured by Gnome, the French aircraft engine company, famous for their rotary engines during the first World War. This engine, the "Monosoupape" (French for "One Valve") was extremely simple. Its intake and exhaust were directly from and to the atmosphere through a common port. There were no manifolds. To ensure a fresh charge of air on intake it depended on the propeller to quickly clear exhaust from the port. As such an arrangement would not permit carburetion, fuel was injected directly into the cylinders. Unfortunately the oily exhaust seriously impaired the pilot's vision and this, rather than a deficiency in mechanical design, prevented it from achieving any lasting success. There are few places where such an engine, exhausting directly to the atmosphere without a muffler, can now be used. With no way of recovering the considerable thermal energy in the exhaust it is impossible to achieve the optimum efficiency of this engine and, furthermore, with the noise emissions of such an unmuffled engine there are few places it could be used today.

A number of variations of the "Monosoupape" design have appeared since, but none of these have, to applicant's knowledge, ever reached production. With the addition of manifolds it becomes necessary to have a second valve that will connect the poppet valve port with the appropriate manifold at the proper time. Almost all previous engines have used some form of rotary valve to perform this "distribution" function. Basically these are pistons revolving in cylindrical sleeves; as they revolve, passages cut through the pistons line up with ports in the sleeve and permit the gases to flow. Usually the cylinders of these rotary valves were mounted on the same shaft as the poppet valve actuating cams to reduce the number of parts. The complexity of the parts often offset the advantage sought by reducing their number.

In the previous engines, the exhaust port closes before the intake port opens, to prevent exhaust from blowing back into the air intake. This has two serious drawbacks. First, it traps exhaust gas between the rotary valve and the poppet valve at the end of the exhaust stroke. As the trapped gas has to be ingested back into the cylinder on the intake stroke, the amount of fresh charge drawn into the cylinder per cycle is reduced. Secondly, as the rotary valves are designed to run at half the engine speed, the inlet port cannot fully open until well into the intake stroke and the exhaust port has to commence closing before the end of the exhaust stroke. With the passage rotating it is impossible to maintain full passage opening throughout either intake or exhaust strokes and therefore turbulence and restricted flow cannot be avoided. Moreover the passage arrangement through most of these rotary valves, even when fully open, would seem to impose serious flow restrictions. All of the above factors tend to negate the advantage gained by the large single poppet valve.

To fully realize the inherent advantage of a "Monosoupape" engine, the problems associated with previous designs (as outlined above) must be reduced or eliminated. To accomplish the above stated objective, this invention uses a specially devised diverter valve, in conjunction with fuel injection and a supercharger driven by an exhaust turbine, to create a combined system that will: (a) minimize the flow friction to and from the cylinders, (b) purge the exhaust gas, and (c) recover as much thermal energy from the exhaust as economics and the state of the art permit.

The diverter valve is a two-position valve that alternately connects the poppet valve port to the inlet and exhaust manifolds. It serves the same function as the rotary "distributor" valve in the prior art. The design objective is to give the smoothest unrestricted flow with minimum turbulence. The arrangement and timing are devised to give full flow through the entire intake stroke and almost all of the exhaust stroke. The mechanism is timed to permit a short purge at the end of the exhaust stroke.

Fuel must be injected directly into the cylinders, as purging with fuel-laden air would waste fuel and create problems of flashback and hydrocarbon pollution.

To achieve the purge function, it is necessary to maintain a higher pressure on the inlet side of the diverter valve than the back pressure from the exhaust manifold—hence the supercharger. This prevents exhaust gases from entering the intake and eliminates the need for a perfect seal on the diverter valve.

With the larger valve and intake passages, more air will be drawn into the cylinder, allowing more fuel to be burned per cycle. The additional energy from the extra fuel cannot all be absorbed in the power stroke as the expansion volume remains the same. Therefore, as exhaust begins, the combustion products will have a higher energy level. With the larger valve and passages, less of this energy will be lost due to exhaust throttling. The cumulative result is a considerable increase in the energy available to drive the exhaust turbine.

The invention is illustrated by way of example in the accompanying drawings wherein.

Figure 1B:
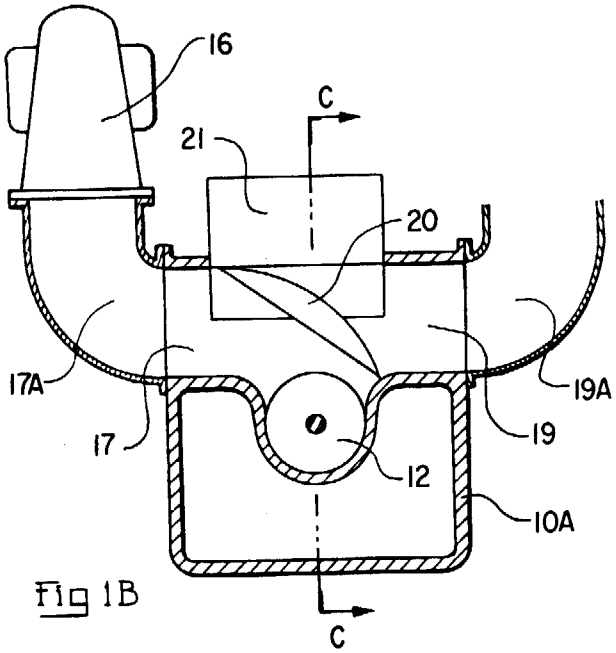
FIG. 1B is a top, partial sectional view of FIG. 1A.
Figure 1C:
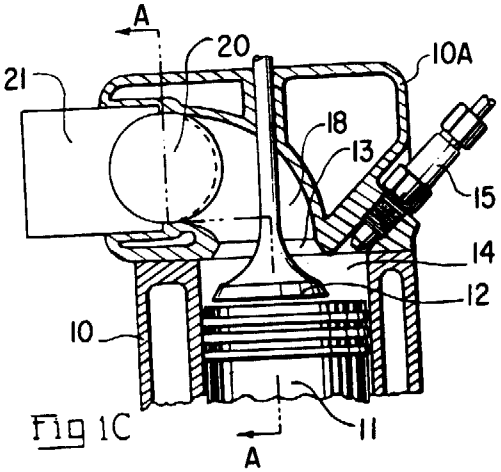
FIG. 1C is a left hand sectional view of FIG. 1A.
Figure 1A:
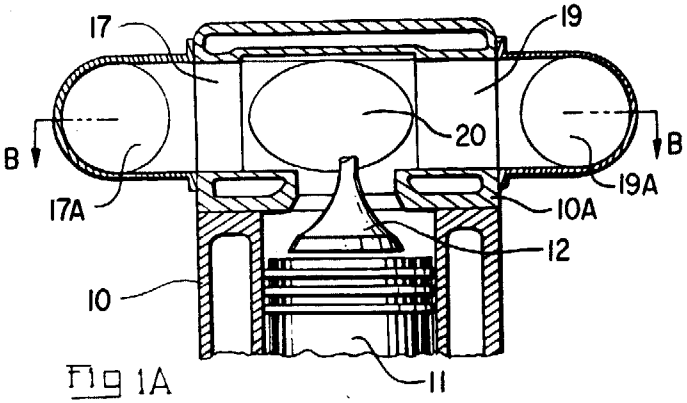
FIG. 1A is a side partial sectional view of a one cylinder internal combustion engine having a valve arrangement provided in accordance with the present invention.
Figure 2B:
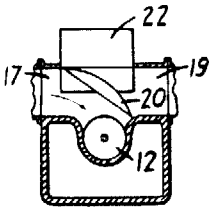
Figure 2A:
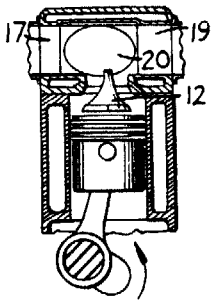
Figure 7:
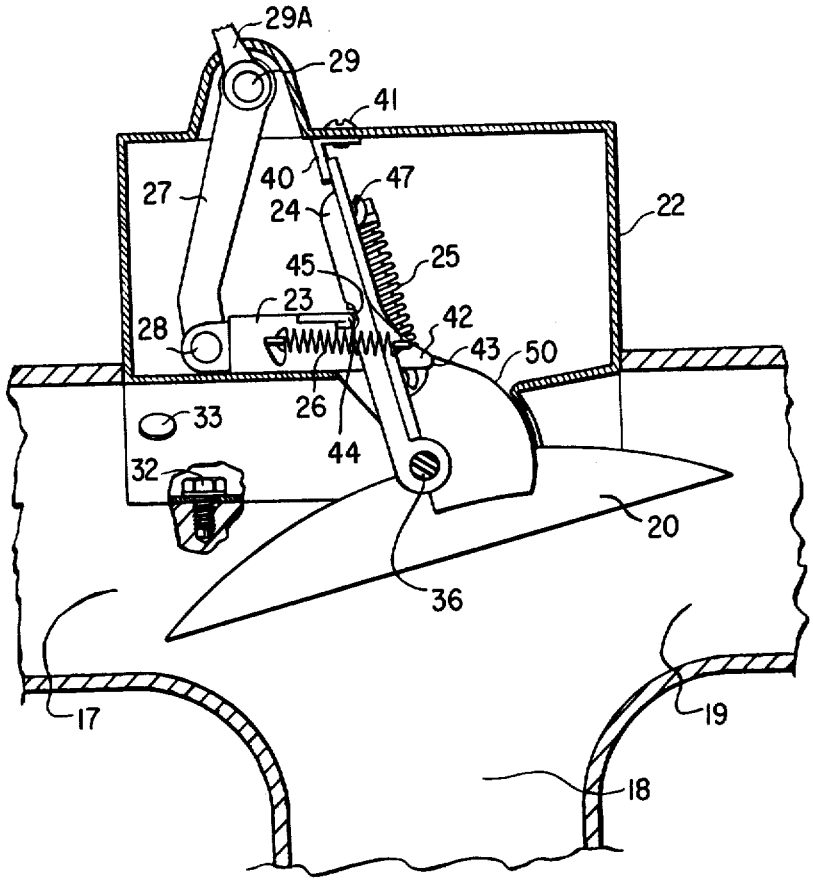
Figure 8:
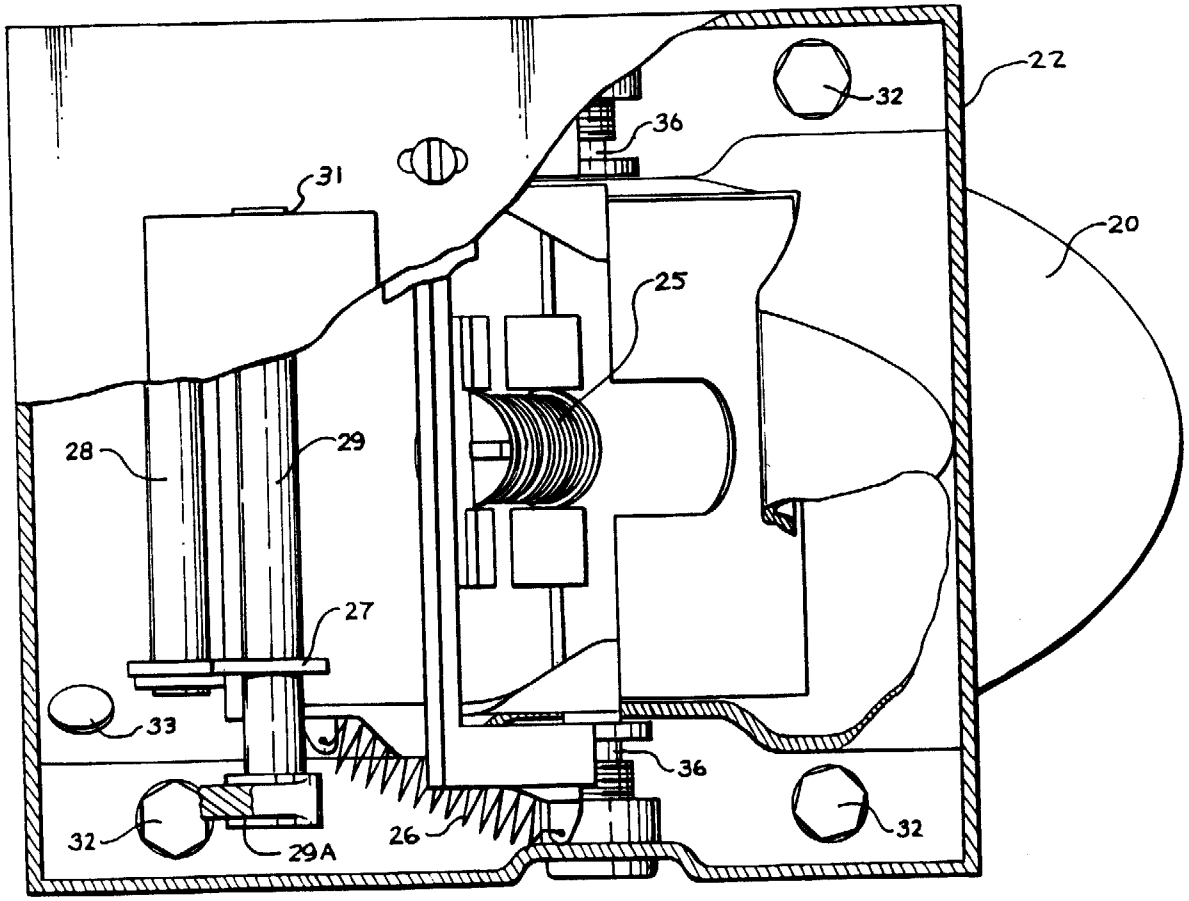
Figure 9:
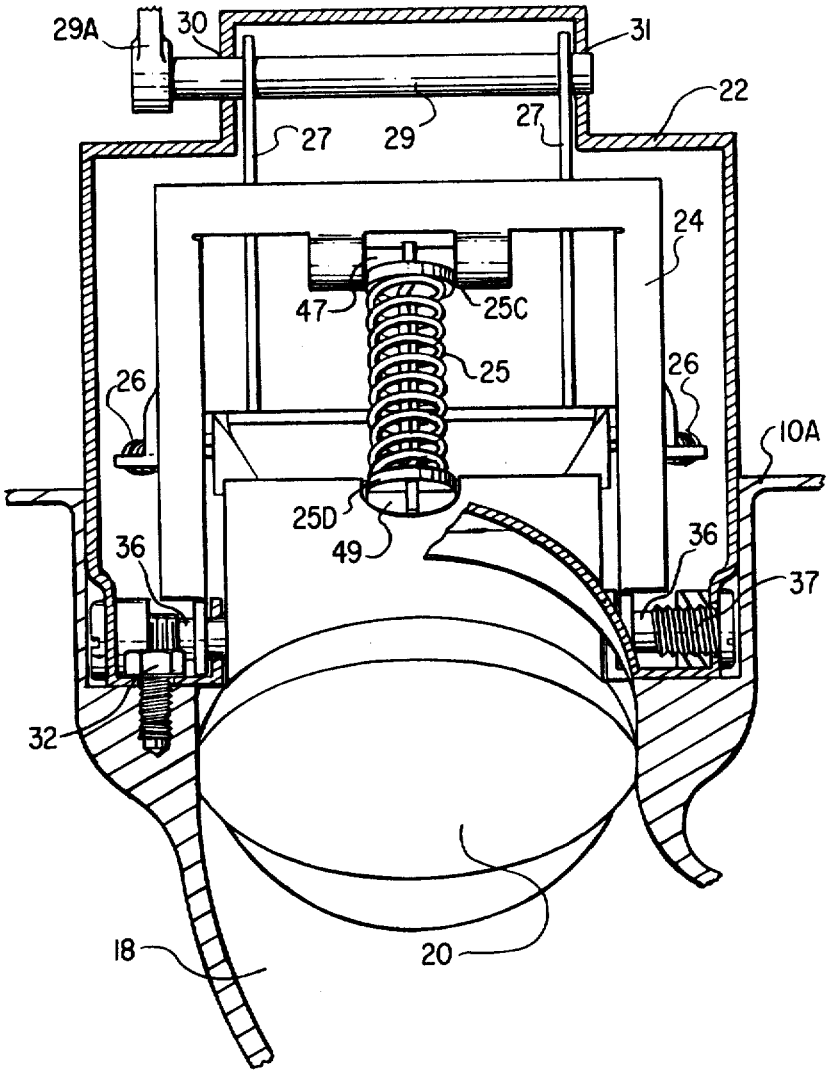
Figure 10:
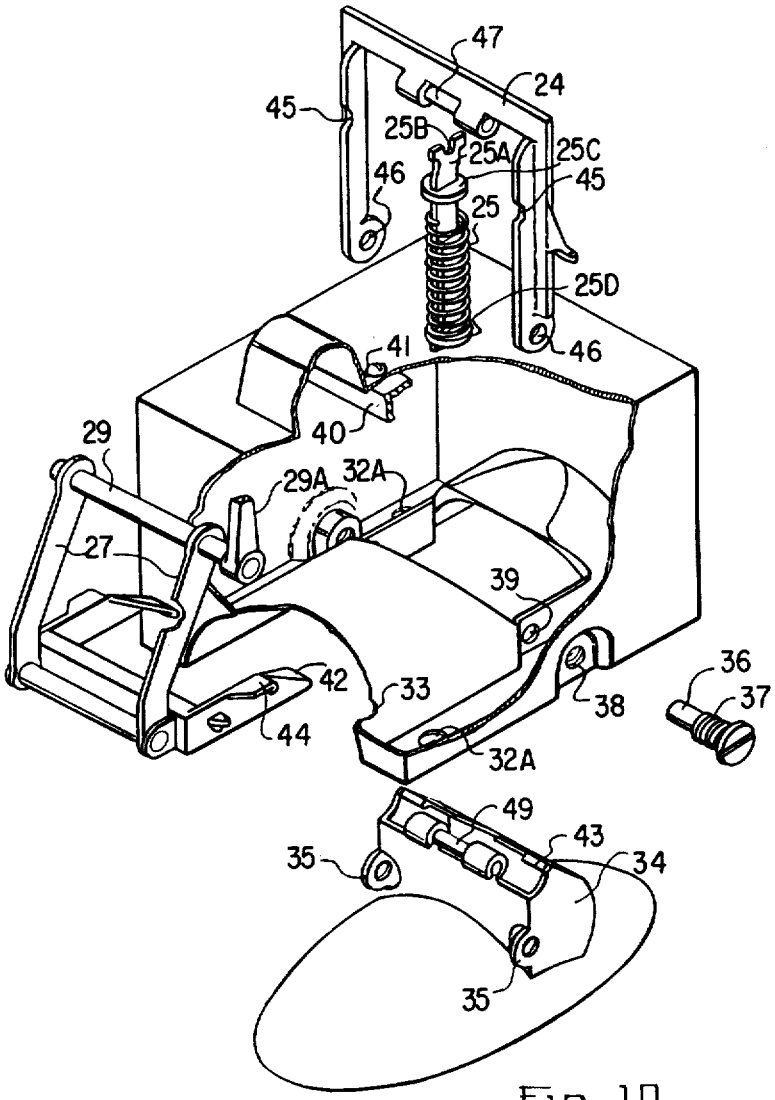

FIGS. 2A through 6A inclusive are front partial sectional views taken along stepped line A—A of FIG. 1 illustrating the piston and poppet valve positions for respectively the intake, compression, power and exhaust portions of the cycle and top dead center (T.D.C.);

FIGS. 2B through to 6B inclusive illustrate the position of the diverter valve for different portions of the engine cycle;

FIG. 7 is a partial cross-sectional view of the diverter valve assembly containing the diverter valve and taken essentially along line B—B of FIG. 1;

FIG. 8 is a partial broken top view of FIG. 7;

FIG. 9 is a partial broken right hand view of FIG. 7;

FIG. 10 is an exploded view of the diverter valve mechanism illustrated in FIGS. 7 to 9; and FIGS. 11A to 11F inclusive illustrate various different relative positions of the diverter valve and operating mechanism thereof for the various different portions of the cycles of operation of the combustion engine.

For convenience of the reader, reference numerals referred to in the following description with reference to the accompanying drawings designate the various different parts as follows:

| | | | |
|---|---|---|---|
| 10 | cylinder block | 29 | actuating shaft |
| 10A | cylinder head | 29A | actuating crank arm |
| 11 | piston | 30 & 31 | actuating shaft journals |
| 12 | single poppet valve | 32 | mounting studs |
| 13 | poppet valve seat | 32A | casing mounting stud holes |
| 14 | combustion chamber | 33 | pressurizing hole |
| 15 | fuel injector | 34 | D.V. rear structure |
| 16 | super charger | 35 | D.V. pivot lugs |
| 17 | inlet passage | 36 | D.V. pivot shaft |
| 17A | inlet header | 37 | pivot shaft thread |
| 18 | combustion chamber passage | 38 | pivot shaft nut |
| 19 | exhaust passage | 39 | pivot shaft support hole |
| 19A | exhaust header | 40 | adjustable stop |
| 20 | diverter valve (D.V.) | 41 | stop mounting screws |
| 21 | D.V. mechanism | 42 | inner forward dogs |
| 22 | D.V. casing | 43 | D.V. engagement notches |
| 23 | actuator (pusher) | 44 | rear outer dogs |
| 24 | yoke | 45 | yoke engagement notches |
| 25 | compression spring assembly | 46 | yoke pivot mounting holes |
| 25A | spring guide | 47 | spring pivot pin yoke |
| 25B | spring guide notches | 48 | |
| 25C | upper collar | 49 | spring pivot pin D.V. |
| 25D | lower collar | 50 | curved rear surface. |
| 26 | tension spring | | |
| 27 | actuating arms | | |
| 28 | actuator pivot pin | | |

Referring now to the drawings, there is illustrated in FIGS. 1A, 1B, 1C and 2A to 6A inclusive a portion only of a single cylinder internal combustion engine which includes a block 10, a cylinder head 10A, a piston 11 and a single poppet valve 12, movable into and out of sealing contact with a valve seat 13 by a conventional cam operated mechanism (not shown). Fuel for the combustion engine is fed in appropriate timed relation into the combustion chamber 14 by an injector 15 of conventional design and operated in a conventional manner known to those skilled in the art. Air for combustion, pressurized by a turbo charger 16 driven by exhaust gases from the engine, flows in the direction of A (see FIG. 2B) in an inlet passage 17 through a passage 18 into the combustion chamber. Exhaust gases flow out from the combustion chamber, through the passage 18 and through a passage 19 which is a continuation of passage 17. In a multi-cylinder engine, inlet passages 17 are connected to a common header 17A (see FIGS. 1A and 1B) and exhaust passages or outlets 19 are connected to a common header 19A. A spoon shaped diverter valve 20 is located at the junction of passages 17 and 19 opposite passage 18. The diverter valve 20 is a part of a diverter valve mechanism identified in general in the drawings by reference numeral 21. The diverter valve mechanism consists essentially of six parts (see FIGS. 7 to 10 inclusive) namely, an enclosed box or casing 22, a pusher 23, a yoke 24, a compression spring assembly 25, a tension spring 26 and the diverter valve 20. The pusher 23 is connected to one end of a pair of arms 27 by pivot pin 28 and the other end of the arms are connected to rotate with a shaft 29 which is journalled as at 30 and 31 in walls of the casing 22. The arms 27 are rocker arms for reciprocating the pusher mechanism and are oscillated back and forth about the axis of shaft 29 by a cam mechanism (not shown) acting on crank arm 29A. The cam mechanism is driven, in any convenient manner, in timed relation to rotation of the engine crankshaft. The enclosed box or casing 22 is detachably mounted in a recess in the head 10A of the engine in which passages 17, 18 and 19 are located. The closure box is detachably mounted by studs 32 passing through respective ones of a plurality of apertures 32A in the bottom wall of the casing. The underside of such bottom wall is concave to conform to the diameters of the respective intake and exhaust passages or ports 17 and 19. One or more holes 33 in the bottom wall of the casing provide air passage means from passage 17 into the interior of the casing whereby the latter is pressurized by the incoming supercharged combustion air, when the diverter valve is in the intake position.

The diverter valve 20 has a structure 34 on the rear face thereof on which there is located a pair of spaced apart lugs 35. Lugs 35 provide means for pivotally mounting the diverter valve on the enclosed box by way of shafts 36 projecting from the end of a threaded stud 37 that thread into a threaded aperture 38 (or nut attached to the casing) in respective ones of opposed side walls of the casing. The end of each shaft 36 project into an aperture 39 in the casing. The yoke 24 has apertures 46 on the free ends thereof which likewise pivot on the shafts 36. The casing 22 thus provides support structure for a common pivot axis for both the diverter valve 20 and the yoke. The diverter valve when flipped about the pivot axis alternately seals the intake and exhaust ports 17 and 19.

The yoke 24 provides the means to flip the diverter valve through the over-centre action of the compression spring 25 as will become more apparent hereinafter. Movement of the yoke is limited in one direction by a stop 40, secured to the enclosed box 22 by screws 41. The yoke 24 is driven by the engine by the cam-operated rocker arm 29A via the pusher 23 so as to operate in timed relation with rotation of the engine's crankshaft.

The pusher 23 is pivotally connected to the lower end of the cam operated rocker arm 27 and is normally held abutting against the yoke 24 by the tension of a pair of springs 26 except when the stop 40 limits the return travel of the yoke. The tension springs 26 are so attached as to align an inner pair of dogs 42 on the free end of the pusher to engage with respective ones of a pair of notches 43 on the structure 34 attached to the diverter valve. The pusher has a pair of outer dogs 44 spaced rearwardly from the dogs 42 and are located so as to engage notches 45 on the yoke.

When the pusher (as viewed in FIG. 7) is driven to the right by the rocker arm, the pusher dogs 44 engage notches 45 on the yoke 24 and rotate the yoke about its pivot (pin 36). When the pusher is pulled back to the left, the yoke is pulled back by the pre-tensioned springs 26 until the upper end of the yoke strikes the stop 40 on the enclosed box.

The compression spring 25 is fitted over a variable length spring guide 25A having notches 25B at each of opposite ends thereof (see FIG. 10). The notches 25B receive pivot pins 47 and 49 mounted respectively on the yoke 24 and diverter valve 20. The compression spring is located between collars 25C and 25D secured to respective ones of a pair of members providing the variable length spring guide 25A. The force of the spring keeps the collars at opposite ends of the variable length guide in engagement with the respective pivot pins 47 and 49. The depth of the notches is such the collars press against the respective pins 47 and 49. The pins 47 and 49 are secured to their respective members by a pair of spaced apart hooks, the distance between which corresponds to the width of the respective collars 25C and 25D. This maintains the spring guide centered between the lugs. The over center action of the spring assembly rapidly and positively flips the diverter valve from one position to the other when the yoke is moved by the pusher. Effectively the spring pressure creates two stable positions for the diverter valve on either side of alignment of the spring guide with the yoke. The diverter valve is flipped from the exhaust-purge position to the intake position at the end of top-dead-centre and from the intake to the exhaust position at about the end of the compression stroke.

The transition from exhaust position to the exhaust-purge position is achieved by the movement of the pusher to the right as viewed in FIG. 7 from the extreme left position. The inner dogs 42 on the pusher engage the notches on the diverter valve trip arms and rotate the diverter valve about its axis to the purge position.

While the diverter valve rotates, the compression spring 25 and spring guide 25A are also being rotated about pin 47, as pin 49 moves with the diverter valve. This continues until the compression spring and spring guide pass through the position of alignment with the yoke 24. At this point (which occurs just before the outer dogs 44 engage with the notches 45 on the yoke), the diverter valve flips to the intake position.

Further movement of the pusher 23 to the right rotates the yoke about its axis of pins 36 since the outer dogs 44, on the pusher are in engagement with the notches 45 on the yoke. With continued movement of the pusher the yoke is rotated to the point where it passes through alignment with the compression spring 25 and spring guide. The diverter valve 20 then flips back to the exhaust position. The pusher, driven by the rocker arm gradually moves back to the starting position and as the pusher 23 returns, the tension springs 26 pull the yoke 24 back. To do this the spring must be adequately pre-tensioned to overcome the force imposed by the compression spring 25. The inner dogs 42 on the pusher ride up over the back 50 of trip arms on the diverter valve under the action of the tension springs 26. At the extreme end of the pusher's return stroke, the tension of springs 26 aligns the pusher so that the inner dogs 42 are ready again to engage the notches 43 on the trip arms of the diverter valve when the pusher resumes movement. more details of the actions are described hereinafter with reference to FIGS. 11A to 11G inclusive.

The general shape of the diverter valve 20 is that of a spoon with the handle cut off. The form of its convex rear face is such it fits tangentially to the concave wall of either manifold passage 17 and 19 along one rim, while the opposite edge conforms to the sectional shape of the transition curve from the valve passage 18 to the other manifold passage so as to effectively block that passage. In form, the shape of the rim approximates two halves of an ellipse cut along the minor diameter, with two straight sections added so as to lengthen the major diameter.

The structure 35 on the back face of diverter valve 20 is a light gauge metal appendage which provides the pair of notches 43 engageable with the inner dogs 42 on the pusher. These arms have a curved back edge 50 over which the dogs ride upon during the return movement. In this appendage are located a pair of bearings on which the valve is mounted and pivoted. Between the two arms is mounted the pin 49 on which the lower end of the compression spring and spring guide are pivoted.

FIGS. 11A to 11G show the diverter valve operation sequence and FIGS. 2A to 6A and 2B to 6B the relationship of the diverter and poppet valve positions during operation.

Figure 5B:
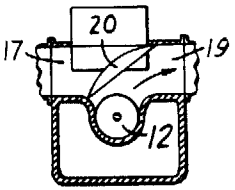
Figure 5A:
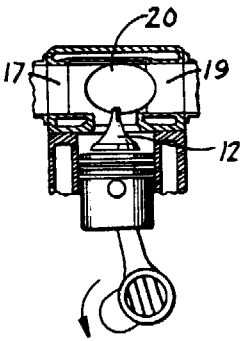
Figure 4B:
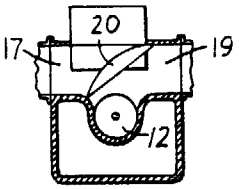
Figure 4A:
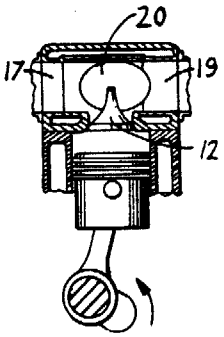
Figure 3B:
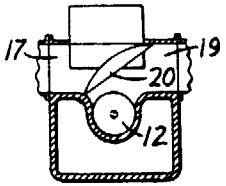
Figure 3A:
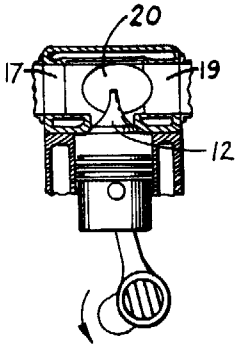
Figures 11A, 11B, 11C, 11D, 11E, 11F:
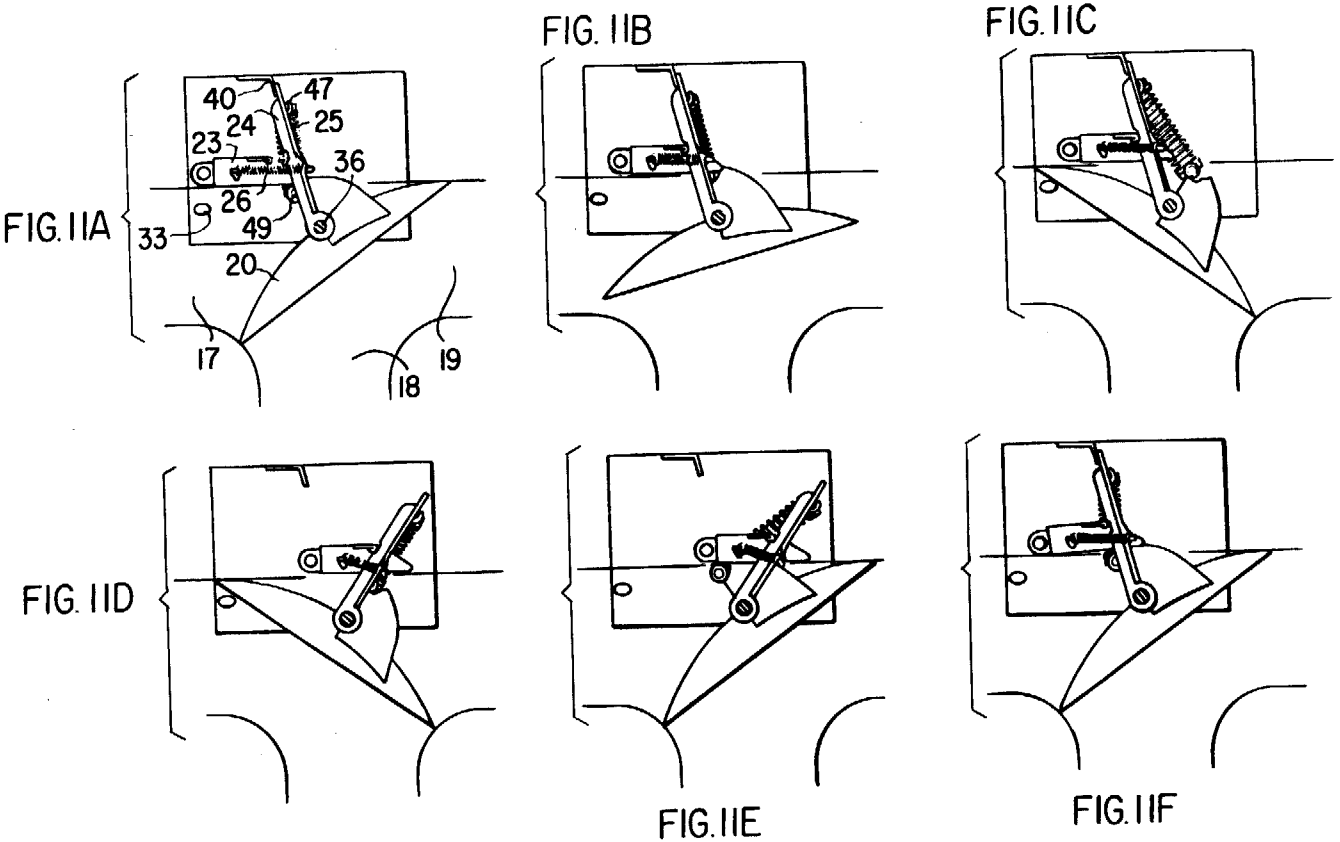

In FIG. 11A, the usher is at its position of maximum retraction, in the latter half of the exhaust stroke, corresponding to FIG. 5A. The diverter valve seals the inlet 17 and diverts exhaust gases from the cylinder to the exhaust manifold through passage 19. The tension spring holds the yoke against the stop and at the same time aligns the pusher so that the inner dogs on the pusher are lined up to engage with the notches on the diverter valve trip arms.

Figure 6B:
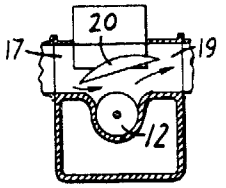
Figure 6A:
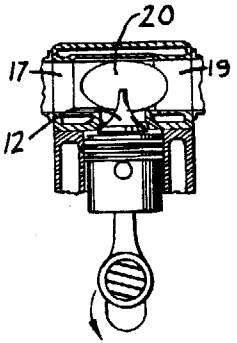

FIG. 11B portrays the subsequent exhaust purging operation towards the end of the exhaust stroke, corresponding to FIG. 6A. The pusher has moved to the right, tipping the diverter valve through the action of the inner dogs on the diverter valve notches. This allows the supercharged inlet air to flow past the diverter valve and scavenge the exhaust gases. Pressure of the supercharged inlet air must be greater than the exhaust back pressure.

At the end of the exhaust stroke, when the piston is at top-dead-centre and about to commence the intake stroke, the diverter valve is tipped so that the compression spring has just reached the overcentre position. The diverter valve then flips to the intake position as shown in FIG. 11C and corresponding to FIG. 2A. The flowing inlet air is directed by the valve so to flow into the cylinder through the open poppet valve. Precise timing can be achieved by adjustment of the position of the stop.

At about this instant, further movement of the pusher to the right engages its outer dogs with the notches on the yoke, tilting the yoke until it reaches the position shown in FIGS. 11D. At this point the compression spring is again at the over-centre position and the diverter valve flips back to the exhaust position, FIGS. 11E and 4A. This action should occur near the beginning of the compression stroke, but its timing is not critical since the poppet valve is closed.

The pusher is now drawn back and the tension spring pulls the yoke with it, the inner dogs on the usher riding up over the diverter valve trip arms. This continues until the yoke comes up against the stop on the enclosure box, at which point the outer dogs on the puller disengage from the yoke as shown in FIG. 11F, corresponding to the exhaust stroke shown in FIGS. 4–6.

The tension spring now stretches as the pusher is further withdrawn until, near the end of the travel, the inner dogs clear the diverter valve trip arms and the spring tension realigns the inner dogs with the notches on the trip arms. The diverter valve is again positioned as in FIG. 11C ready for the start of a new cycle.

In the foregoing there is described a mechanical arrangement for controlling movement of the diverter valve such that in one position the inlet gases are directed into the combustion chamber and in another position outlet gases are directed to the exhaust passage and another position therebetween where the pressurized air flowing in the inlet passage is allowed to flow directly through to the outlet passage for purging. It will be obvious other types of diverter valve may be used to accomplish the same result. Movement of the diverter valve may be effected by use of electrical and/or electronic means, pneumatic means and/or hydraulic means. Differently shaped and/or constructed diverter valves may also be utilized to accomplish applicant's function of appropriately directing the flow of gases to and from the combustion chamber and from the inlet to the outlet for purging at the end of the exhaust portion of the cycle.

I claim:

1. In a fuel injected, internal combustion engine of the type having a single poppet valve for controlling the flow of air to the combustion chamber and exit of exhaust gases therefore, the improvement comprising:

(a) an inlet passage for the supply of air under pressure;

(b) an outlet passage for exit of exhaust gases, said outlet passage communicating with said inlet passage as a continuation thereof;

(c) a further passage terminating at one end in said combustion chamber and at the other end at the junction of said inlet and outlet passages, said single poppet valve being arranged and operated to control the flow of gases through said further passage into and out of said combustion chamber in timed relation to rotation of the engine's crankshaft, all of said passages being circular in cross-sectional shape;

(d) a spoon shaped diverter valve disposed within a housing removably mounted and located at the junction of said inlet and outlet passages, said diverter valve being selectively moveable in timed relation with opening and closing of the poppet valve so as in one position to direct flow of pressurized air through the inlet passage into the combustion chamber and later, in another position, the flow of combustion gases from the combustion chamber through the outlet passage; and (e) an over centre snap action spring biased means controlling movement of said diverter valve from each of one position to another and controlled such that when moved from said another to said one position the initial movement is slow allowing pressurized air to flow directly from said inlet passage to said outlet passage to assist in driving out the exhaust gases.

2. The improvement as defined in claim 1 wherein said engine is a multi-cylinder engine and the inlet passages and outlet passages are connected to respective ones of a pair of common headers and wherein said spoon shaped diverter valve has the concave surface thereof facing said first passage in each of said diverter valves one and another positions.

* * * * *